United States Patent [19]

Flohr

[11] Patent Number: 4,856,999

[45] Date of Patent: Aug. 15, 1989

[54] ELECTRIC ADAPTER CONNECTOR

[75] Inventor: Peter Flohr, Ringheim, Fed. Rep. of Germany

[73] Assignee: Heinrich Kopp GmbH & Co. KG

[21] Appl. No.: 116,077

[22] PCT Filed: Jan. 20, 1986

[86] PCT No.: PCT/EP86/00017

§ 371 Date: Oct. 9, 1987

§ 102(e) Date: Oct. 9, 1987

[87] PCT Pub. No.: WO87/04570

PCT Pub. Date: Jul. 30, 1987

[51] Int. Cl.[4] ..... H01R 29/00

[52] U.S. Cl. ..... 439/52; 439/53; 439/171; 439/652

[58] Field of Search ..... 439/52, 53, 151, 166, 439/168–175, 189, 217–224, 518, 626, 638, 639, 640, 650–656, 658; 200/175, 176, 177, 178, 179, 180, 336; 337/256, 257, 258, 259, 289

[56] References Cited

U.S. PATENT DOCUMENTS

| | | | |
|---|---|---|---|
| 2,423,512 | 7/1947 | Mantilla et al. | 337/259 |
| 3,609,649 | 9/1971 | Rigolini | 439/151 |
| 4,196,409 | 4/1980 | Juba | 439/651 |

FOREIGN PATENT DOCUMENTS

| | | | |
|---|---|---|---|
| 1933653 | 2/1970 | Fed. Rep. of Germany | 439/170 |
| 2414203 | 10/1975 | Fed. Rep. of Germany | 439/171 |

*Primary Examiner*—David Pirlot
*Attorney, Agent, or Firm*—Horst M. Kasper

[57] ABSTRACT

In order to connect small electric apparatus having for example a two-pin configuration or a European flat plug into any of the international standard plugging systems according to need, a handy pentaprism-shaped connector has on its sides plug pin arrangements (2) for five different plugging systems and contains a revolving body (4, 7) which has in the area of the top and/or bottom surface of the connector sockets for two more plugging systems. These can be manually snapped (8, 9) into contact (3, 5, 6) with the plug pin arrangement (2) of the connector needed at any time, the remaining plug pins being then absolutely deprived of any voltage.

20 Claims, 2 Drawing Sheets

ELECTRIC ADAPTER CONNECTOR

Figure 1:
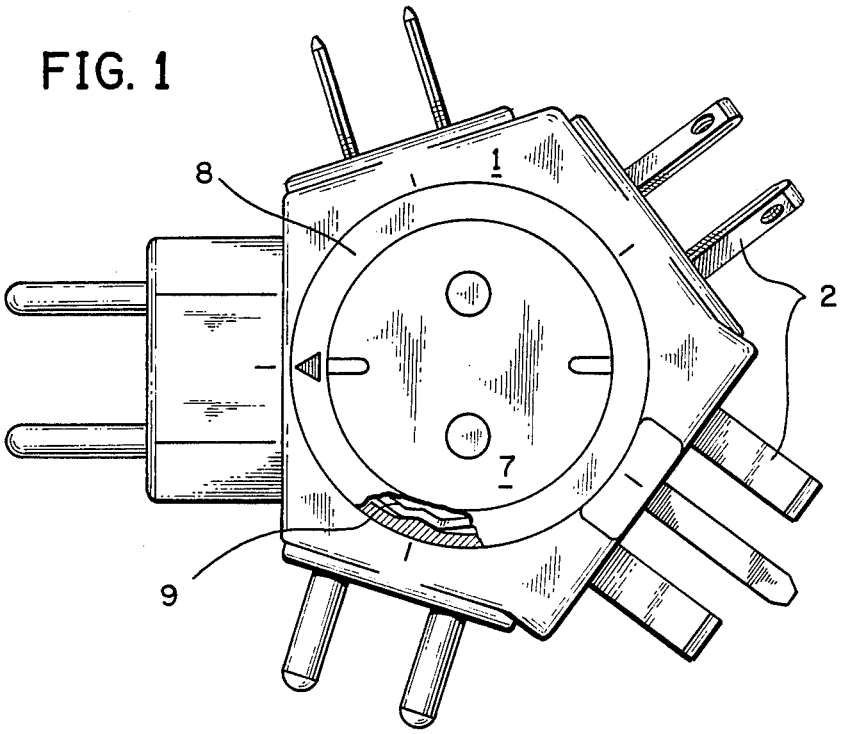

The invention relates to an electric connection element shaped as an adapter, in order to be able to use therewith, for example, electric small appliances without grounding contact of the kind of an adapter plug on foreign travel, where the wall plugs of the appliances, adapted to the respective home country, can be used in wall outlets present in various other countries and continents.

So-called travel plug sets are known for this purpose. These travel plug sets comprise several adapter plugs, each of which is individually suitable only for the adaptation of the home-country plug system to one defined other system. Since it is frequently not known to the user which particular plug system is employed in another country and since the user therefore always has to carry with him several separate adapter plugs, which are easily lost, this kind of construction has not proven to meet the requirements. In addition, it has been attempted in the past to provide one and the same adapter plug, by means of a shifting mechanism and by screwing out of individual plug pins, for several different plug systems. However, this construction is quite complicated and is hardly properly and safely operable by a non-skilled person, even with the aid of operating instructions.

In view of the above, it is an object of the invention to develop an electric adapter element by way of which the plug systems existing around the world can be adapted in a practical and safe way for receiving power from a certain type of wall plug. In addition, it is desired that a compact article of common use be provided which does not allow any operator intervention in its contact system and which is completely contact-voltage proof during use.

This object is achieved in an electric connection piece or adapter according to the preamble of patent claim 1 and by the features presented in the characterizing portion of claim 1. The adapter according to the invention represents in such a construction advantageously also a handy accessory, which can be plugged, depending on the type of plug system available on the spot, with the corresponding plug pin arrangement into the fixedly installed wall outlets or, possibly, into a flying or overhung coupling in order to be able to use the plug pin arrangement, after the adjustment of the marked rotary body in direction of the receiver part, in the one and the same home wall outlets for the connection of the electric appliance carried along. In addition, the plug system selector contained in the adapter exhibits sometimes the useful switch-on and switch-off effect in that the respectively unused, exposed plug pin arrangements are absolutely free of voltage toward the outside.

In the same way, the plug body can be formed for a more limited application range of the adapter. Only three or four plug pin arrangements can be formed in its geometrical form with the same advantages as trigonal prismatic or tetragonal prismatic shape. Respectively, the adjustable wall outlets provided in the cover face and/or base face can be constructed, according to their system, uniformly or also differently, without thereby extending beyond the protection range of the invention.

The feature of claim 2 is directed toward an advantageous formation of the movable connection and contact parts of the adapter. Consequently, the two female contact elements or socket elements comprise in the same manner a longitudinally extended U-shaped folded brass plate strip, where the two socket elements are inserted, in each case, below the existing plug-in openings and are supported with the aid of tip-stretched or formed-on web protrusions at the rotary body. In this context, the parallel running longitudinal arms or branches of these socket elements, connected to each other via the web-like reduced cross arm or branch, are arched or curved with respect to each other and, in each case, provided with two oppositely disposed cross slots. In this manner, three plug-in regions, independent of each other, are formed which allow, for example, to accept or contain a plug or connector pair from the one side in the middle and, at the same time, next to this connector pair, from the other side, two other connector pairs, which are independently spring-loaded. Furthermore, the outer longitudinal arms or branches of the socket elements extend over a punched-out area in each case into forwardly protruding sliding contact arms at an inclined angle. The sliding contact arms make contact, depending on the setting or adjustment, in the mounted state of the adapter under spring tension with the fixed contact elements of the various plug pin arrangements, which fixed contact elements are disposed at the inner wall of the hollow cylinder-shaped opening of the plug body on a circular course.

In order to assure mechanically the various contact positions at the adapter, according to the feature of claim 3, it is provided that the rotary body, provided at least on one outside with a gripping edge or border pulled up around the plug insertion recess, is equipped, within a ring-shaped hollow space of the rotary body, with a number of engagementor detent cams corresponding to the existing plug pin arrangements, which engagement cams, in each contact position of the rotary body and of its wall plug(s), grip springingly simultaneously behind three tip-stretched detent webs which are pulled up at functionally corresponding locations. It is assured in this way that the rotary body can engage clearly perceptible in the required contact position where, in addition, the visual display indicating the chosen plug pin arrangement is shown on the gripping edge or border.

According to the feature of claim 4, the rotary body is formed to connect the existing plug pin arrangements of the plug body on the one or on the two plug-free sides of the adapter with a wall plug or, respectively, with two wall plugs of the same system or also of different systems. For this purpose, the rotary body is comprised of two shaped parts or formed pieces, made of insulating material, guided movably on two sides inside of the plug body. The formed parts of insulating material engage lockingly, for example, with two oppositely disposed support webs in the edge region between the socket pieces, while a third, centrally tip-stretched web allows the screwing in from the outside of the formed parts in the course of the installation. In this context, for example, one of the formed parts is provided in itself with two plug-in openings for a contour plug or also a two-pole protection pin plug, while the other formed part can be provided with four pairs of parallel disposed plug-in openings for the insertion of two Europe flat-cable plugs. On the other hand, it is also possible to exchange one of the recited formed parts against a correspondingly formed cover disk, if there should be no requirement for a second wall plug arrangement.

Figure 2:
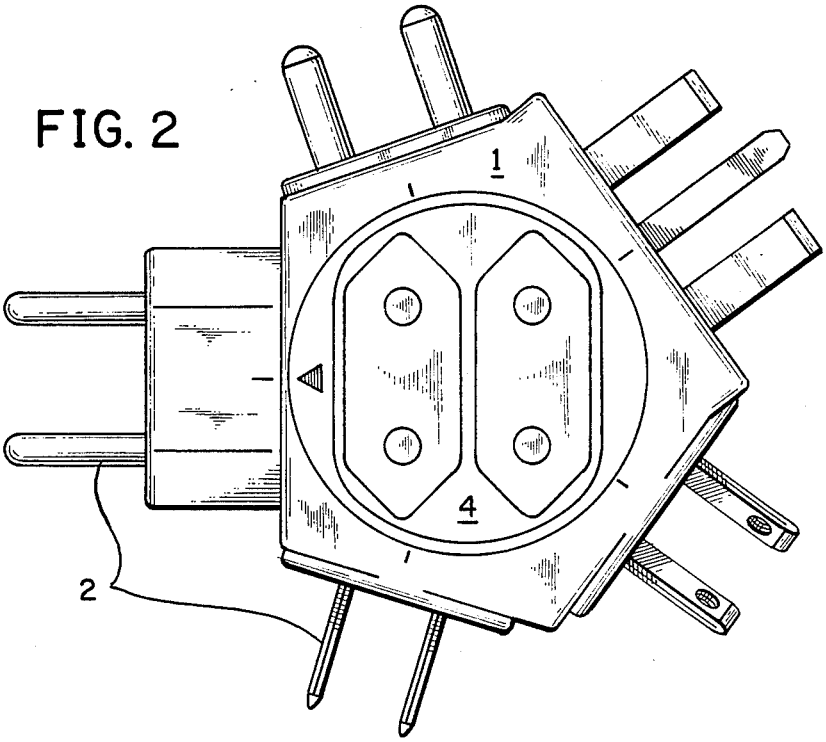
Figure 3:
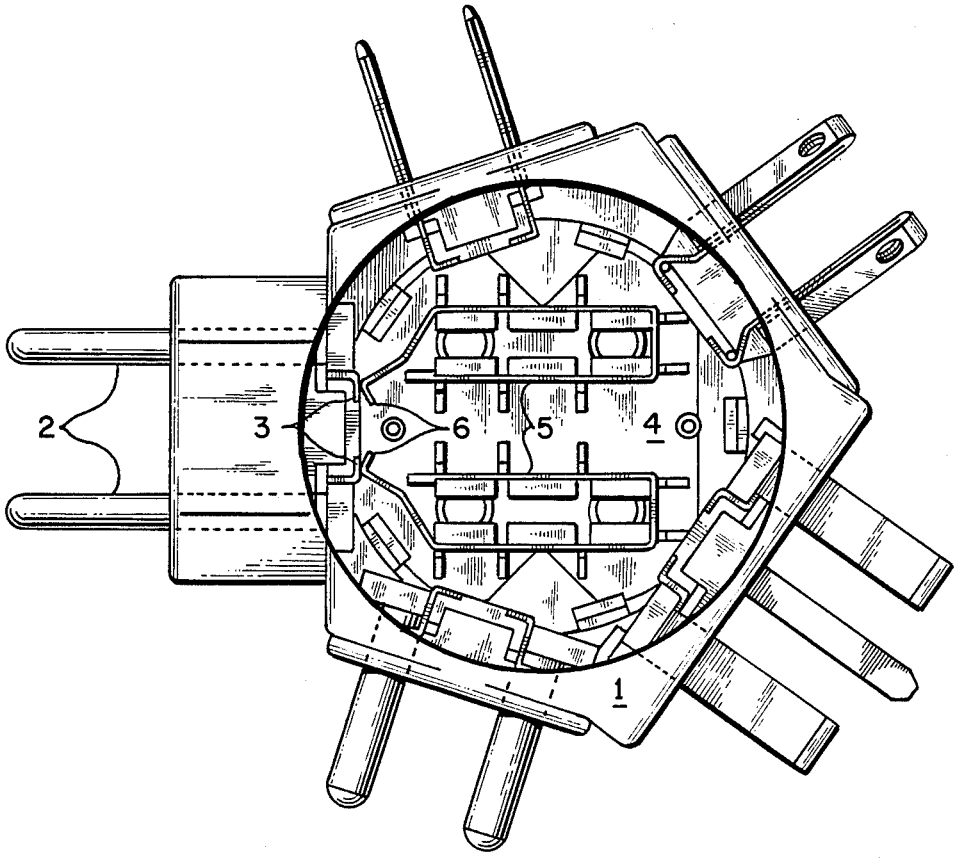

An electric adapter is shown as an embodiment of the invention in the attached drawing. The adapter allows the connection of an electric appliance provided with a 2-pole contour or Europe plug without grounding contact to all internationally standardized plug systems. There is shown in FIG. 1 a plan view onto the cover surface of the adapter with the wall plug for the contour plug;

FIG. 2 a view of the base surface with the wall plugs for two Europe flat-cable plugs; and FIG. 3 the adapter according to the representation in FIG. 1 with the rotary-body formed part taken off.

As can be gathered from the representations, the plug body (1) of the adapter geometrically has the shape of a straight five-sided prism and is provided in its central region with a cylindrical recess passing through from the cover surface toward the base surface. One of the different plug pin arrangements (2) is solidly placed into each of the five side faces of the plug body (1). The pole contact terminals of the plug pin arrangements (2) run out, in each case, at the inner wall of the cylindrical recess, into fixed contact pieces (3) disposed on a circular path.

In addition, it can be seen from the drawing of FIG. 3, that the two socket elements (5) are U-shaped, which are supported on the formed part (4) of a rotary body forming the base surface of the adapter at the four plug-in openings for the plug pins of two Europe plugs by means of tip-stretched web protrusions and that the socket elements (5) in themselves are subdivided threefold and in addition are provided at their outer longitudinal arms with angled, protruding sliding contact arms (6). The sliding contact arms (6) come into conductive contact, in each case, with that pair of the pre-cited fixed contact pieces (3) of one of the plug-pin arrangements (2) at an equal distance, where the rotary body has been manually position-adjusted to that pair with the aid of the formed part (7), which forms the cover surface of the adapter and which has been removed from the representation of FIG. 3 for clarity's sake. For this purpose, the formed part (7) of the rotary body provided with two plug-in openings for the plug pins of a contour plug is at the same time provided with an (arrow)-marked gripping edge (8). The detent provision (9), which is represented in FIG. 1 of the drawing as a partial section, is disposed under the gripping edge (8) in cooperation and co-action with the plug body (1).

Consequently, it can be gathered from the drawn illustration, without additional suggestions that the, by way of example, presented combination of the various plug pin and socket elements (2, 5), in each case, can be varied according to the national requirement and that the adapter, based on its constructive formation, in addition allows the incorporation of a further contact element, for example, of an additional grounding contact.

I claim:

1. Electric adapter for an elective adaptation of a certain plug system to a plurality of different plug systems, characterized in that two-pole plug-in arrangements (2) of different types of plug systems are inserted into a side face of a pentagonal-prismatically formed plug body (1) of insulating material and which different types of plug systems protrude inwardly with pole contact terminals as fixed contact pieces (3), disposed on a circular path, in order to be contacted by sliding contact arms of respective socket elements (5) contained on a cylindrical rotary body (4,7), which rotary body (4,7) is centrally and lockably adjustable inside of the plug body (1) and where the socket elements (5) are accessible through plug-in openings in a cover surface of the rotary body (4,7) or in the cover surface and in a base surface.

2. Adapter according to claim 1, characterized in that supported socket elements (5) in each case comprise a U-shaped folded sheet metal strip, where the socket elements (5) are supported below the plug-in openings by means of tip-stretched webs at the rotary body (4, 7), and where the socket elements (5) comprise, in each case, a U-shaped folded sheet metal strip, where an inwardly curved longitudinal arm of the U-shaped folded sheet metal strip are cross-slotted in themselves for a spring-loaded reception of one or more (located alongside, inserted) plug pins, where an outer longitudinal arm extends web-like in a spring-loaded sliding contact arm (6).

3. Adapter according to claim 1, characterized in that the rotary body (4, 7) is provided on the outside with a gripping edge (8) pulled up around plug insertion recesses, under which gripping edge (8) there are tip-stretched in a corresponding number cams which springingly grip behind detent webs (9) pulled up in a circular ring shape from the plug body (1) at a functionally corresponding position in the respective position of the rotary body (4, 7).

4. Adapter according to claim 1, characterized in that the rotary body (4, 7) is composed of two formed parts of insulating material guided inside of a base surface and cover surface of the plug body (1), where the formed parts of insulating material are provided with different plug insertion recesses, for example, for a contour or a grounding-contact plug and for two Europe flat-cable plugs, which interlock via several support webs and which are centrally screwable together, where one of the formed parts can be exchanged against a contour-locking cover plate guided inside of the plug body (1).

5. An electric adapter for a desired adaptation of a certain plug system to a plurality of different plug systems, comprising a prismatically formed plug body made of insulating material corresponding to a repetition number of rotary symmetry;

a rotary body having plug-in openings in its surface and which is disposed inside the prismatically formed plug body for assuming different positions and which rotary body is disposed near the center of the prismatically formed plug body and which rotary body is lockable and adjustable with respect to its position inside of the prismatically formed plug body;

socket elements supported at the rotary body and including a sliding contact arm, which socket elements are accessible through plug-in openings in the surface of the rotary body;

two-pole plug-in arrangements of different types of plug systems having pole contact terminals as fixed contact pieces and inserted into the prismatically formed plug body, made of insulating material, which two-pole plug-in arrangements of different types of plug systems protrude inwardly into the prismatically formed plug body with their pole contact terminals as fixed contact pieces and which two-pole plug-in arrangements are disposed in pairs on a circular path in order to be contacted by the sliding contact arm of the socket elements supported at said cylindrical rotary body depending on the positioning of the rotary body in each case relative to the prismatically formed plug body.

6. The electric adapter for a desired adaptation of a certain plug system according to claim 5 wherein
the prismatically formed plug body is a pentagonal prismatically formed plug body.

7. The electric adapter for a desired adaptation of a certain plug system according to claim 5 wherein
the prismatically formed plug body is a tetragonal prismatically formed plug body.

8. The electric adapter for a desired adaptation of a certain plug system according to claim 5 wherein
the prismatically formed plug body is a trigonal prismatically formed plug body.

9. The electric adapter for a desired adaptation of a certain plug system according to claim 5 wherein
the socket elements are tri-pole socket elements.

10. The electric adapter for a desired adaptation of a certain plug system according to claim 5 wherein
one of the socket elements is accessible through a plug-in opening in a cover surface and a base surface of the rotary body.

11. The electric adapter for a desired adaptation of a certain plug system according to claim 5
wherein the rotary body comprises tip-stretched webs for supporting the socket elements below the plug-in openings;
wherein the socket elements in each case comprise a U-shaped folded sheet metal strip;
wherein the sliding contact arm is spring-loaded;
wherein the U-shaped folded sheet metal strip has an inwardly curved longitudinal arm, which longitudinal arm is cross-slotted in itself for a spring-loaded reception of a plug pin, and wherein an outer longitudinal arm extends web-like into the spring-loaded sliding contact arm.

12. The electric adapter for a desired adaptation of a certain plug system according to claim 5
wherein the rotary body is provided with plug insertion recesses; wherein the rotary body is provided on the outside with a gripping edge pulled up around the plug insertion recesses;
wherein the prismatically formed plug body includes detent webs pulled up in a circular ring shape from the plug body and which detent webs are disposed at a position functionally corresponding to a respective position of the rotary body;
wherein the rotary body is provided with tip-stretched cams corresponding in number to the number of detent webs and disposed under the gripping edge, which cams springingly grip behind said detent webs.

13. The electric adapter for a desired adaptation of a certain plug system according to claim 5 wherein the prismatically formed plug body has a base surface and a cover surface;
wherein the rotary body is composed of two formed parts of insulating material guided inside of a surface base and cover surface of the plug body;
wherein the formed parts of insulating material are provided with different plug insertion recesses, which different plug insertion recesses are provided with several support webs and which plug insertion recesses interlock via the several support webs and which different plug insertion recesses are centrally screwable together; and
wherein one of the two formed parts can be exchanged against a contour-locking cover plate guided inside of the plug body.

14. The electric adapter for a desired adaptation of a certain plug system according to claim 13
wherein one of the plug insertion recesses is provided for a contour plug.

15. The electric adapter for a desired adaptation of a certain plug system according to claim 13
wherein one of the plug insertion recesses is provided for a grounding-contact plug.

16. The electric adapter for a desired adaptation of a certain plug system according to claim 13
wherein two of the plug insertion recesses are provided for two Europe flat-cable plugs.

17. An electric adapter for making a connection between different plug systems, comprising a plug body made of insulating material and having faces on the outside disposed such as to correspond to an at least three-fold rotation symmetry;
a rotary body having plug-in openings in its surface and which rotary body is disposed inside the plug body for assuming different positions and which rotary body is disposed near the center of a prismatically formed plug body and which rotary body is lockable and adjustable with respect to its position inside of the prismatically formed plug body;
socket elements supported at the rotary body and including a sliding contact arm, which socket elements are accessible through plug-in openings in the surface of the rotary body; two-pole plug-in arrangements of different types of plug systems having inwardly directed pole contact terminals as fixed contact pieces and inserted into the plug body made of insulating material, which two-pole plug-in arrangements of different types of plug systems protrude inwardly into the plug body and which pole contact terminals are disposed in pairs on a circular path in order to be contacted by a respective sliding contact arm of the socket elements supported at the rotary body, depending on the positioning of the rotary body relative to the plug body.

18. The electric adapter for a desired adaptation of a certain plug system according to claim 17
wherein the socket elements, in each case, comprise a folded sheet metal strip;
wherein the rotary body comprises tip-stretched webs for supporting the socket elements below the plug-in openings;
wherein the sliding contact arm is spring-loaded;
wherein the folded sheet metal strip has an inwardly curved longitudinal arm, which longitudinal arm is cross-slotted in itself for a spring-loaded reception of a plug pin, and wherein an outer longitudinal arm extends web-like into the spring-loaded sliding contact arm.

19. The electric adapter for a desired adaptation of a certain plug system according to claim 18
wherein the rotary body is provided with plug insertion recesses; wherein the rotary body is provided on the outside with a gripping edge pulled up around the plug insertion recesses;
wherein the prismatically formed plug body includes detent webs pulled up in a circular ring shape from the plug body, and which detent webs are disposed at a position functionally corresponding to a respective position of the rotary body;
wherein the rotary body is provided with tip-stretched cams corresponding in number to the number of the symmetry axis and disposed under the gripping edge, which cams springingly grip behind said detent webs.

20. The electric adapter for a desired adaptation of a certain plug system according to claim 19 wherein the prismatically formed plug body has a base surface and a cover surface;

wherein the rotary body is composed of two formed parts of insulating material guided inside of the base and cover surface of the plug body;

wherein the formed parts of insulating material are provided with different plug insertion recesses, which different plug insertion recesses are provided with several support webs and which plug insertion recesses interlock via the several support webs, and which different plug insertion recesses are centrally screwable together; and wherein one of the two formed parts can be exchanged against a contour-locking cover plate guided inside of the plug body.

* * * * *